US005120256A

United States Patent [19]

Walden

[11] Patent Number: 5,120,256

[45] Date of Patent: Jun. 9, 1992

[54] RETENTION SYSTEM FOR A CONNECTOR HOUSING

[76] Inventor: John D. Walden, 1111 White Dawn La., Mechanicsburg, Pa. 17055

[21] Appl. No.: 730,984

[22] Filed: Jul. 16, 1991

[51] Int. Cl.[5] ..... H01R 13/639

[52] U.S. Cl. ..... 439/553; 439/566

[58] Field of Search ..... 439/83, 553, 566, 563, 439/569, 570

[56] References Cited

U.S. PATENT DOCUMENTS

| | | | |
|---|---|---|---|
| 4,025,147 | 5/1977 | Van Arsdale et al. | 339/176 |
| 4,616,893 | 10/1986 | Feldman | 339/14 R |
| 4,629,278 | 12/1986 | Norton | 439/570 |
| 4,691,971 | 9/1987 | Hahn | 439/78 |
| 4,907,987 | 3/1990 | Douty et al. | 439/571 |
| 5,004,430 | 4/1991 | DelGuidice et al. | 439/350 |
| 5,007,844 | 4/1991 | Mason et al. | 439/83 X |
| 5,026,291 | 6/1991 | David | 439/67 |

FOREIGN PATENT DOCUMENTS

| | | | |
|---|---|---|---|
| 0210686 | 2/1987 | European Pat. Off. | 439/563 |

OTHER PUBLICATIONS

Hirose Inc., Product Literature, HRS DF9 Series, "SMT 1mm Center Line Board To Board Connector", pp. 23-29.

JAE Electronics No. 101, Product Literature, "SX Series Connector".

*Primary Examiner*—Eugene F. Desmond

[57] ABSTRACT

A retention system for retaining a connector housing to a substrate includes a pair of slotted arms extending from the housing and a wedge-shaped abutment member having a camming surface and a latching surface thereon. The leg of an L-shaped clip is insertable into a channel defined by the slotted arms. The clip is deflectable by the camming surface as the leg advances into the channel until at latch bar on the clip snaps into latching engagement with the latching surface on the abutment member, thereby to secure the clip to the housing. The clip is attachable to the substrate to retain the housing to the same.

20 Claims, 7 Drawing Sheets

RETENTION SYSTEM FOR A CONNECTOR HOUSING

BACKGROUND OF THE INVENTION

1. Field of the Invention

The present invention relates to a retention system for retaining a connector housing of a surface mounted connector to a substrate.

2. Description of the Prior Art

Surface mounted connectors are typically used for interconnecting conductive tracings disposed on one surface of a substrate, such as a circuit board, with corresponding tracings disposed on the surface of another substrate. When using a surface mounted connector some provision must be made for retaining the housing of each connector to the surface of its associated substrate.

One typical retaining expedient includes the provision of a retaining member on one or both ends of the connector housing. The member is extensible into a through-hole provided in the substrate. One example of this expedient is the use of retaining hardware, as a bolt attached to the connector housing, and a cooperating nut which threads to the bolt on the undersurface of the substrate to hold the housing in position.

In other examples of this form of retaining arrangement the retaining member is provided with a hook with a barb which engyages the boundary of the through-hole in the substrate. This arrangement is used in the retaining arrangement disclosed in copending application Ser. No. 07/654,854, and copending aplication Ser. No. 07/654,869, both filed Feb. 13, 1991 and both assigned to the assignee of the present invention. Another example of a barbed retaining arrangement is disclosed in U.S. Pat. No. 4, 907,987 (Douty et al.).

In yet another form of such a retaining arrangement the retaining member has a resilient or a compliant feature which permits it to grasp the material forming the boundary of the through-hole. Such an arrangement is shown in U.S. Pat. No. 4,691,971 (Hahn), also assigned to the assignee of the present invetnion.

Other board retention devices are shown in U.S. Pat. No. 4,025,147 (Van Arsdale et al.), U.S. Pat. No. 4,616,893 (Feldman) and U.S. Pat. No. 5,004,430 Del-Guidice et al.).

When using a surface mounted connector having such a retaining member care must be exercised during manufacture of the substrate that the through-holes therein are accurately positioned with respect to the conductive tracings on the surface of the substrate. To avoid problems attendant upon this registration requirement another retaining expedient utilizes a retainer that is securable, as by soldering, to mounting pads provided on the same surface as the conductive tracings. Since the mounting pads may be placed on the surface of the substrate at the same time as the conductive tracings, the pads may be located to tighter tolerances than the through-holes. An example of such a retaining arrangement is the board-to-board connector system manufactured and sold by Hirose Inc. as the HRS DF9 S61

This last-mentioned retaining arrangement uses a rectanguloid abutment tab formed on at least one endwall of the connector housing. An L-shaped retaining clip having a cut-out formed in one leg thereof is inserted onto the abutment tab from the upper surface of the connector husing. The clip is held to the endwall by a pair of arms. The second leg of the clip is soldered or otherwise to the mounting pad, thereby to secure the housing on the surface of the substrate.

During manufacture of this last-mentioned retaining arrangement the retaining clip must be inserted onto the conntector housing from the upper surface of the housing, that is, the surface that lies farther from the substrate when the connector is secured thereto. Although the electrical contact elements of this last-discussed retaining arrangement also happen to be inserted into the housing from the upper surface, there areinstances where it is necessary or desirable to introduce the electrical contact elements into the housing from the lower surface of the housing, that is, from the surface that lies closer to the substrate. For example, if the elecrical contact elemnts are of the type having a curved transition portion that defines an open and a closed end the location the carrier strip on such a contact would make insertion from the lower surface of the housing preferred. In such an istance, to have the retaining arrangement inserted from the upper surface of the housing, additional manipulative steps would have to be performed during the manufacture of the connector. This would be economically disadvantageous.

In view of the foregoing it is believed to be advantage to provide a retention system for a surface mounted connector housing that is retained to mounting pads disposed on the same surface of the substrate as the conductive tracings. Moreover, it is also believed advantageous to provide a retention system in which both the retaining clip and the electrical contacts are introduced onto or into the housing from the housing surface that is prodximal to substrate when the housing is secured thereto.

SUMMARY OF THE INVENTION

The present invention relates to a retention system for retaining a connector housing having a first and second endwall thereon to a substrate. The housing has a first major surface defining a first peripheral edge and a second major surface defining a second peripheral edge. The first major surface of the housing lies proximal to the substrate when the connector housing is retained thereto. The connector housing has a recess therein that extends between the first and second major surfaces. A plurality of electrical spring contact elements are received in the recess, the contact elements being insertable into the housing from the first major surface thereof.

Thee retention system comprises a pair of arms extending from at least the first endwall, the arms having slots therein the cooperate to define a channel. The channel has an inlet end that is adjacent to the first major surface of the endwall. The retention system also includes a wedge-shaped abutment member disposed on the first endwall intermediate the arms forming the pair of arms. The abutment member has a camming surface and a latching surface thereon. The camming surface has a first and a second end. The abutment member extenss for a predetermined length dimension on the endwall between the first end of the camming surface and the latching surface.

The first end of the camming surface is presented to the first major surface of the housing. The first end of the camming surface may either join with the first peripheral edge of the housing or meld with the endwall a predetermined distance on the endwall from the first peripheral edge. The camming surface ramps outwardly form the endwall between the first and second ends thereof such that the second end of the camming surface is disposed a predetermined distance from the endwall.

The retention system further includes a retaining clip, preferably generally L-shaped. The clip has at least a base leg and a latching leg thereon. The clip has an opening, preferably formed in the latching leg of the clip, that defines a latch bar on the latching leg. The opening in the clip has a length dimension generally equal to the length dimension of the abutment member. The latching leg of the clip is insertable into the channel from the inlet end thereof such that the latch bar is deflectable by the camming surface as the latching leg of the clip advances into the channel. The latching leg of the clip is advanced into the channel until the latch bar snaps into latching engagemnt with the latching surface at the second end of the abutment member, thereby to secure the clip to the housing. The base leg of the clip is securable to a substrate, thus to retain the housing to the substrate. The clip may have shoulders provided thereon which abut against the arms when the clips is secured to the housing.

In the most preferred instance the latch. bar has a dimple formed therein. On a first connector the endwall on which the abutment member is disposed is spaced a predetermined distancre away from a portion of the housing thereby to define a clearance space, the clearance space being sized to accommodate a second latch bar associated with a second retention system in accordance with the invention provided on the housing of a second connector. The latch bar of the second retention system also has a dimple therein. The second latch bar is extendable into the clearance space, thereby to place the dimples on the first and the second latch bars into mated engagement, thus holding the first and second connectors in mated engagement.

BRIEF DESCRIPTION OF THE DRAWINGS

The invention will be more fully understood from the following detailed description thereof taken in connection with the accompanying drawings, which form a part of this application and in which.

DETAILED DESCRIPTION OF THE INVENTION

Figure 1:
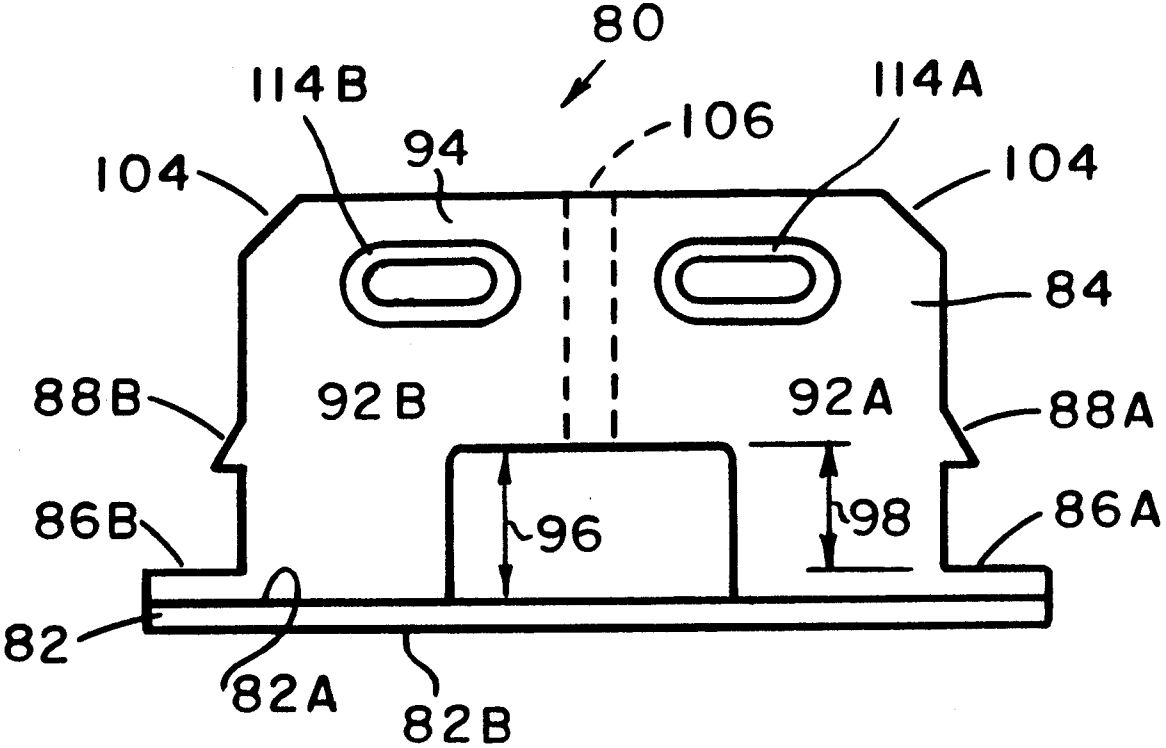
FIG. 1 is a front elevational view of a retaining clip forming a part of the retention systme of the present invention.

Throughout the following detailed description similar reference numerals refer to similar elements in all figures of the drawings.

With reference to FIGS. 1 to 4 shown is a retention system generally indicated by the reference character 10 (shown collectively in FIG. 4) for retaining a connector housing 12 to the surface 14 of a substrate 16. The substrate 16 may either take the form of any rigid mounting member, such as a printed circuit board, or a flexible mounting member.

The housing 12 is formed of a insulating material and has an overall configuration of a generally rectanguloid member. As is perhaps best seen in FIG. 3 the housing 12 includes a first, base, portion 18 and a second, contact casing, protion 20 formed integrally therewith. The exterior surface of the base portion 18 defines a first major exterior surface 22 of the housing 12. The first major exterior surface 22 terminates in a first peripheral edge 24. The first exterior surface 22 and the first peripheral edge 24 lie proximal to the substrate 16 when the connector housing 12 is retained thereto.

Figure 3:
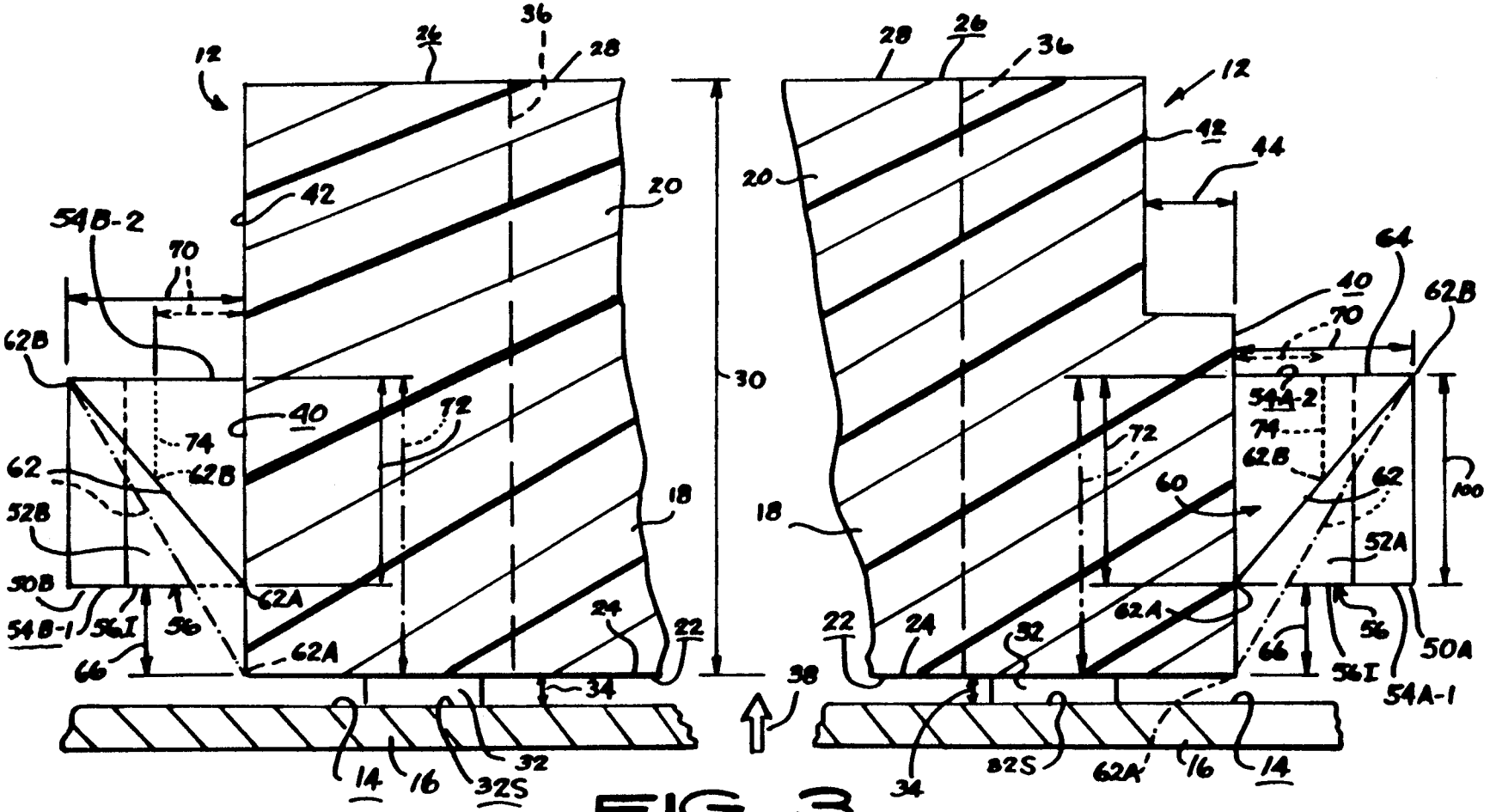
FIG. 3 is a side elevational view in section, taken along section lines 3—3 in FIG. 2, illustrating various locations at which the wedge-shaped abutment member may be disposed on the endwall of the connector housing.

The exterior surface of the contact casing portion 20 defines a second major exterior surface 26 of the housing 12. The second major exterior surface 26 has a second peripheral edge 28. The second major exterior surface 26 is spaced from the first exterio/r surface 22 by the height dimension 30 of the housing 12 (FIG. 3). The first major exterior surface 22 may have standoffs 32 (FIG. 3) provided thereon, the standoffs 32 spacing the first surface 22 any convenient distance 34 from the substrate 16.

The housing 12 is provided with a central cavity, or recess, 36 that receives electrical spring contact elements (not shown). The recess 36 extends through the housing 12 from the first major surface 22 to the second major surface 26 thereof. During manufacture the electrical spring contact elements are introduced into the recess 36 of the housing 12 in the direction of the arrow 38 (FIG. 3), that is, from the first major surface 22 thereof. Preferably, the interior of the housing and the form and arrangement of the electrical spring contact elements therein is as disclosed and claimed in copending application Ser. No. 07/730,985 (EL-4340), filed comtemporaneously herewith and assigned to the assignee of the present invention.

The first, base, portion 18 of the housing 12 has first and second endwalls 40 thereon. Similarly, the contact casing portion 20 of the housing 12 also has first and second endwalls 42.

The housing 12 may be arranged as shown at either the right-hand end or left-hand end of FIG. 3. In one instance, illustrated only in the righ-hand portion of FIG. 3, the endwall 42 on the contact casing portion 26 is offset from the endwall 40 on the base portion 18 by a predetermined distance 44. As will developed, the clearance space defined by the offset distance 44 finds utility in one preferred use of the present invention. In another instance, illustrated for convenience on the left-hand end of FIG. 3, the endwall 42 on the contact casing portion 26 is coplanar with the endwall 40 on the the base portion 18. It is, of course, understood that in the preferred case both lateral ends of a given connector housing 12 will exhibit the same endwall configuration, i.e., one in which the endwalls 40, 42 on both lateral ends of the housing are either offset or coplanar with each other.

Figure 2:
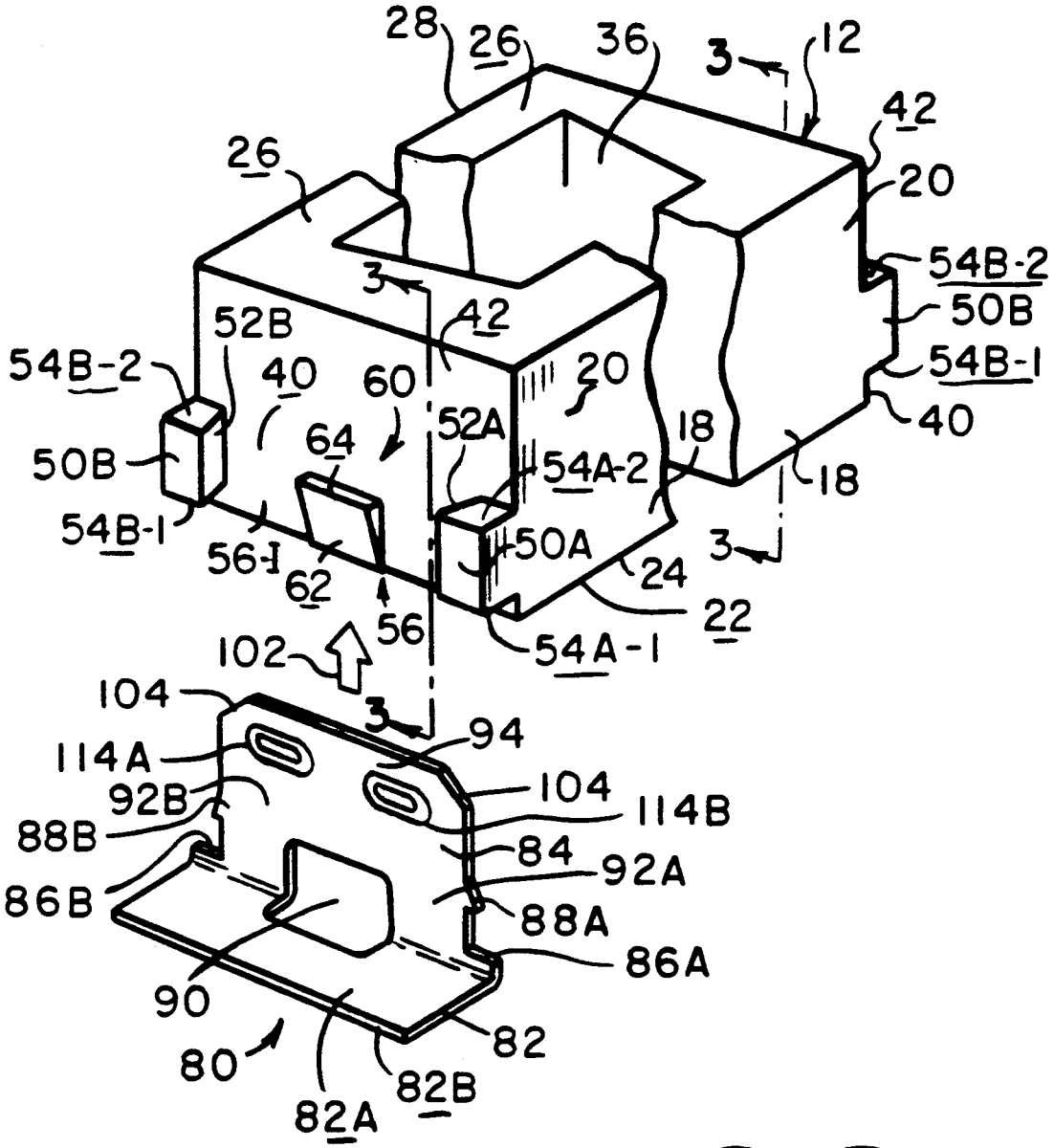
FIG. 2 is a perspective view of the retaining clip, as shown in FIG. 1, and of a wedge-shaped abutment member that also forms part of the retention system or the present invention, the abutment member being formed on an endwall of a connector housing, with the retaining clip about to be inserted onto the abutment member on the housing.

In accordance with this invention the retention system 10 includes at least a first pair of arms 50A, 50B extending from at least one endwall 40 of the base portion 18. Preferably the arms are provided on each endwall 40 of the base portion 18. Each of the arms 50A, 50B has respective slot 52A, 52B therein. The arm 50A has a first and a second surface 54A-1, 54A-2, respectively, thereon while the arm 50A has a first and a second surface 54B-1, 54B-2, respectively. The slots 52A, 52B cooperate with the endwall 40 to define a channel 56 (FIGS. 2 and 3). In the preferred case the slots 52A, 52B are inclined with respect to the endwall 40, thereby to define a dovetail shaped channel. The channel 56 has an inlet end 56I that is, in the preferred case, disposed adjacent to the first major surface 22 of the housing 12. Thus, the inlet end 56I of the channel 56 is presented toward to the same major surface 22 of the housing 12 from which the contact spring elements are inserted into the recess 36 and the major surface 22 that lies adjacent to the surface 14 of a substrate 16 when the connector housing 12 is mounted on and retained thereto.

The retention system 10 also includes a wedge-shaped abutment member 60 disposed on the first endwall 40 intermediate the arms 50A, 50B thereon. The abutment member 60 has a camming surface 62 and a latching surface 64 thereon. The latching surface 64 is preferably coplanar with the second surfaces 54A-2, 54B-2 on the arms 51B, 50B, respectively, although it may be arranged to lie above or below the same.

The camming surface 62 has a first end 62A and a second end 62B thereon. The camming surface is arranged on the endwall with the first end 62A presented toward the first major surface 22 of the housing 12. In one configuration the first end 62A of the camming surface 62 lies a predetermined distance 66 from the first edge 24 of the surface 22, as is illustrated in FIG. 3 in solid lines. Any convenient distance may be selected for the distance 66, thereby disposing the first end 62A of the camming surface at any convenient location along the endwall 40. Preferably, the end 62A aligns with the first surface 54A-1, 54B-1 on the arms 50A, 50B, respectively. In an alternative configuration the first end 62A of the camminmg surface 62 joins to the edge 24 of the first major surface 22 of the housing 12. This arrangement is shown in FIG. 3 by the dot-dashed lines.

The first end 62A of the camming surface 62 preferably melds smoothly into the surface of the endwall 40 at its point of joinder thereto and should meet the endwall 40 with only slight surface discontinuity. Alternaatively, it lies within the contemplation of the invention to space the first end of the surface 62 a predetermined distance, or step, outwardly from the endwall 40. However, as will be developed, the step should not be so large as to interfere with the passage of a retaining clip 80 (to be described) through the channel 56.

However or wherever the first end 62A of the surface 62 is located with respect to the endwall 40, the second end 62B of the camming surface 62 is disposed a predetermined distance 70 from the endwall 40. The distance 70 is greater that any step (if provided), which is to say that the camming surface 62 ramps outwardly from the endwall 40 as one proceeds in a direction on the endwall 40 from the first end 62A toward the second end 62B. Preferably, the second end 62B of the camming surface 62 should not extend laterally from the endwall 40 past the outer extend of the arms 50A, 50B.

The abutment member 60 has a predetermined length dimension 72 measured on the endwall 40 between the first end 62A of the camming surface 62 and the latching surface 64. If desired, the abutment member 60 may be flattened, as indicated in the dotted lines at 74, adjacent to the latching surface 64 thereon. In such a case, however, the length of the abutment is still defined as the dimension 72 along the endwall 40 between the first end 62A of the camming surface 62 and the latching surface 64.

The retention system 10 further includes a resilient retaining clip 80, best shown in FIGS. 1 and 2. Preferably, the retaining clip 80 is fabricated from an integral piece of any solderable stock, such as a copper alloy material. The clip 80 is securable to the housing 12 and forms the link whereby the same is retained to the surface 14 of the substrate 16. The retaining clip 80 is preferably L-shaped, having at least a base leg 82 and a latching leg 84 thereon. The base leg 82 has a first and a second surface 82A, 82B, respectively thereon. In the preferred case the width dimension of the latching leg 84 is less than the width dimension of the base leg 82, thereby to define a pair of shoulders 86A, 86B generally adjacent to the line of bending defining the L-shape of the clip 80. The latching leg 84 is shown in FIG. 1 to have barbs 88A, 88B thereon. The barbs 88A, 88B may be omitted if desired.

The clip 80 has an opening 90 formed therein. The opening 90 extends through at least the material of the latching leg 84 and, may, as illustrated, also extend through the material of the base leg 82. The opening 90 serves to define on the latching leg 84 a pair of uprights 92A, 92B and a latch bar portion 94. At least that part of the opening 90 that extends through the latching leg 84 has a length dimension 96, measured from the surface 82A of the base leg 82 to the latch bar 94 (FIG. 1) that is as least equal to the length dimension 72 (FIG. 3) of the abutment member 60. Moreover, the configuration of the opening 90 corresponds to the configuration of the abutment member 60. The exterior surface of the shoulders 86A, 86B are arranged to lie a predetermined distance 98 (FIG. 1) from the edge of the latch bar 94, for a purpose to be discussed. The distance 98 is equal to the distance 100 (FIG. 3) defined between the inlet end 56I of the channel 56 and the latching surface 64.

In use, to attach the clip 90 to the connector housing 12 the clip 90 is moved relatively to the housing 12 such that the latching leg 84 of the clip 80 is introduced into the inlet end 56I of the channel 56 in the direction of the arrow 102 (FIG. 2). The latch bar portion 94 on the latching leg 84 rides along the cramming surface 62 and is deflected thereby as the leg 84 is advanced into the channel 56. When the latch bar 94 clears the camming surface 62 the latch bar 94 snaps into latching engagement with the latching surface 64 at the second end 62B of the abutment member 60, thereby securing the clip 80 to the housing 12. Judicious selection of the dimension 98 (FIG. 1) with respect to the distance 100 (FIG. 3), as set out earlier, is insures that the shoulders 86A, 86B abut against the surfaces 54A-1, 54B-1, respectively provided on the arms 50A, 50B when the clip 80 is secured to the housing 12.

The width of the leg 84 of the clip should be selected to facilitate the insertion of the leg 84 into the channel 56 and to permit the advancement of the clip 80 thereinto. To this end, it maybe desirable to bevel the edges of the leg 84, as at 104, or to separate the latch bar 94 into two lobes by providing a slot 106 (FIG. 1) therein. When the clip 80 is secured to the housing 12 the surface 82B of the base leg 82 of the clip 80 is arranged so as to be coplanar with the first major surface 22 of the housing 12 (or with the exterior surfaces 32S, FIG. 3, of the standoffs 32, if provided).

It is noted that the clip 80 of the retention system 10 is secured to the housing 12 from the same direction 102 (FIG. 2) as the direction 38 (FIG. 3) of insertion of the electrical contact springs into the recess 36 of the housing 12. As a result economies of manufacturability are believed achieved using the retention system 10 of the present invention over retention systems that must be inserted onto the housing from a direction different from the direction in which the electrical spring contact elements are introduced into the housing 12.

Figure 4:
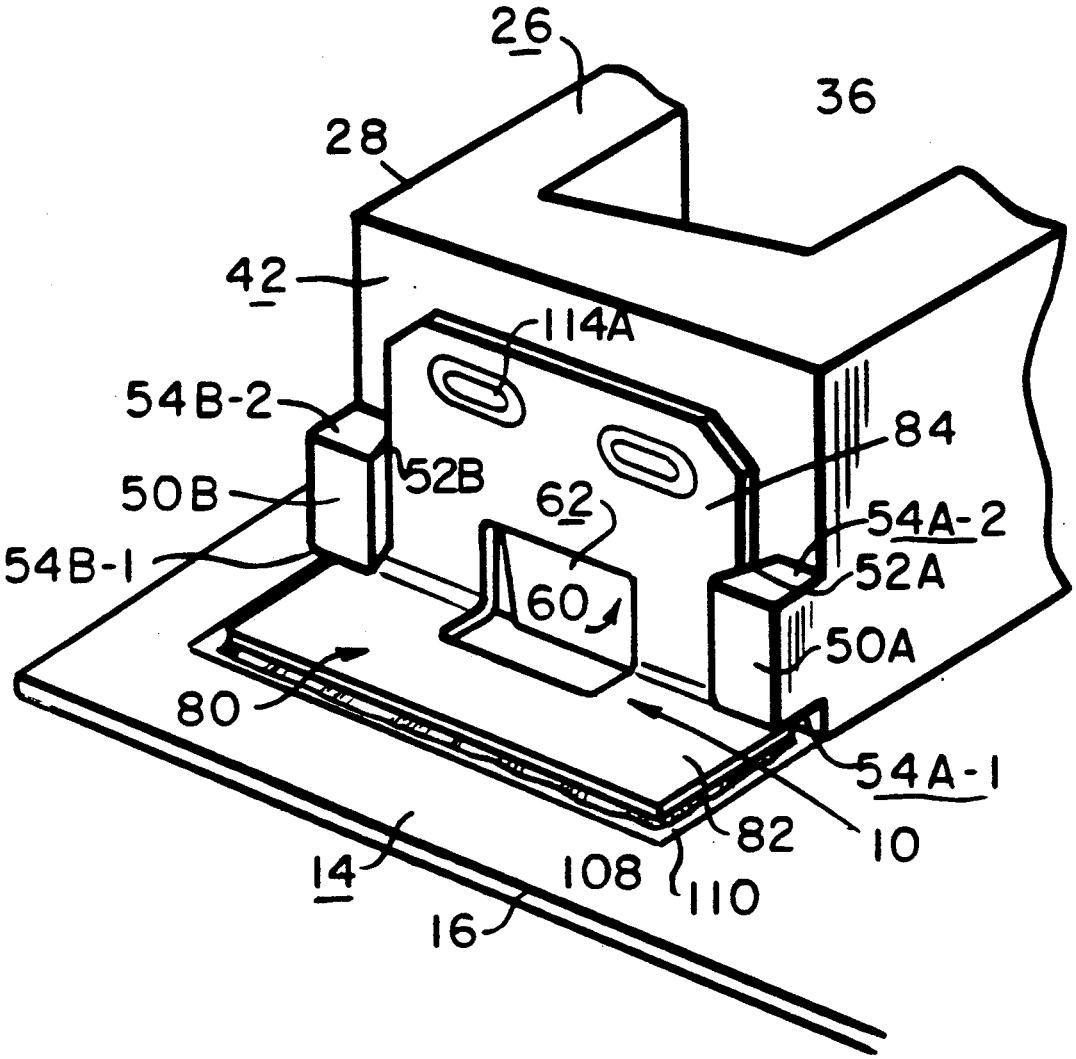
FIG. 4 is a perspective view of the retention system in accordance with the present invention when in use to retain a connector housing to the surface of a substrate.

The base leg 82 of the clip 80 may be secured to the substrate 16 by suitable means, such as the solder bead 108, to a mounting pad 110 on the surface 14 (FIG. 4). If the clip 80 is previously secured to the substrate 16, the housing 12 may be mounted to the clip 80 in a manner similar to that discussed heretofore, thereby to retain the housing 12 to the substrate 16. Alternatively, the clip 80 and the housing to which it is secured may be attached as unit to the surface 14 of the substrate 16 and thus retained thereto.

Figure 5:
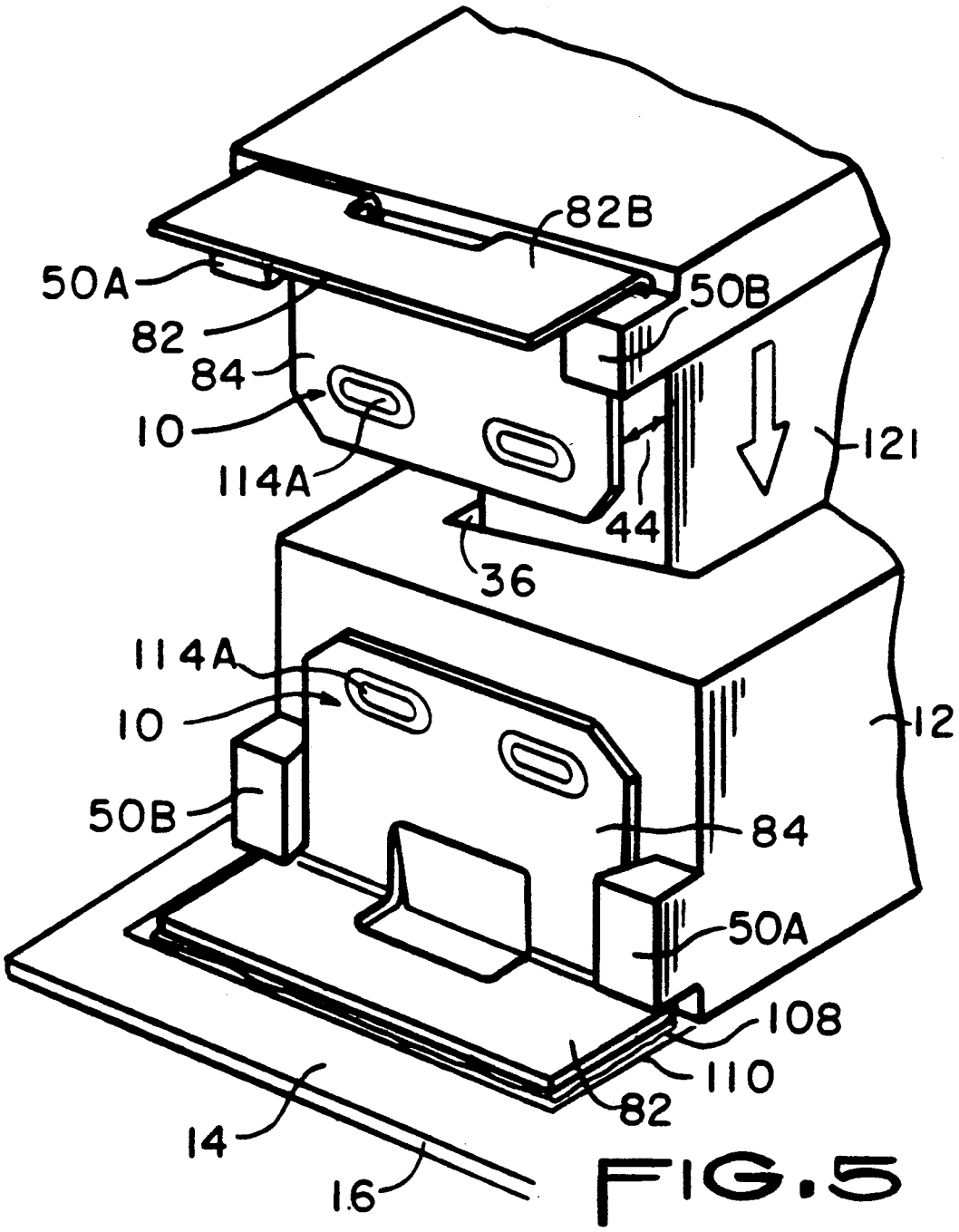
FIG. 5 is a prespective view illustrating the retention system in accordance with the present invention as disposed on a second connector housing as the same is about to be engaged with the retention system provided on the first connector housing.
Figure 6:
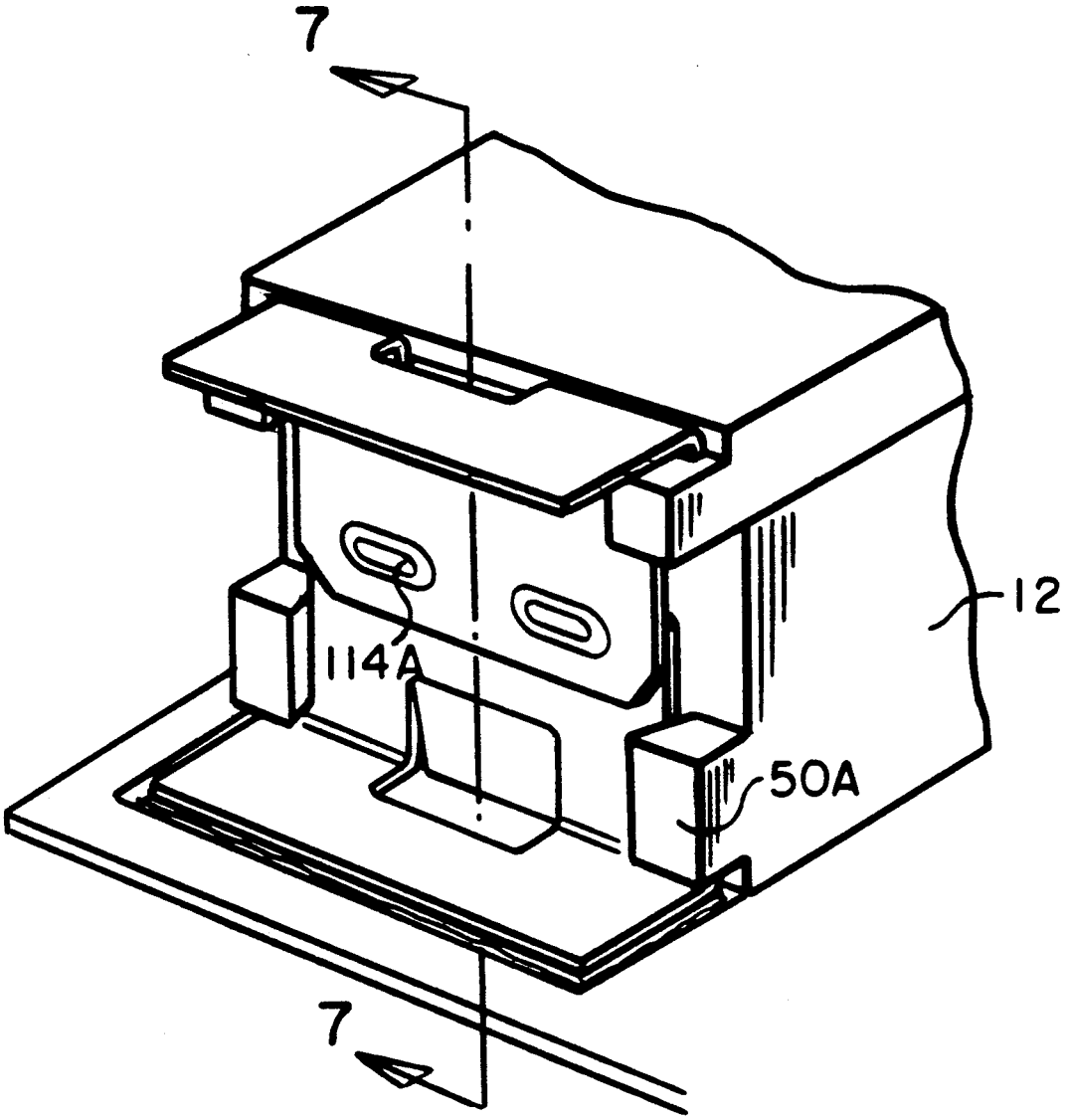
FIG. 6 is a perspective view illustrating the retention systems on the first and second connector housings when fully matedly engaged.
Figure 7:
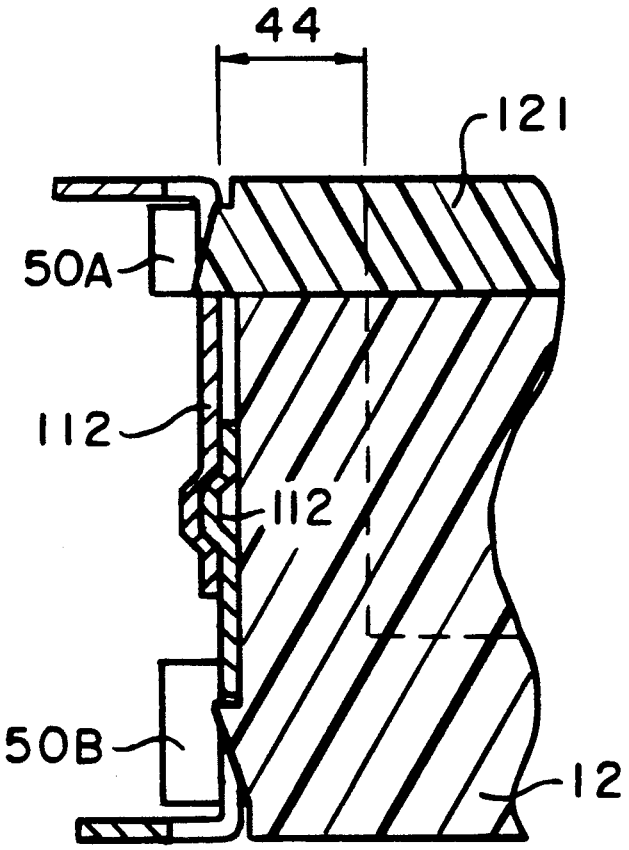
FIG. 7 is a sectional view taken along section lines 7—7 in FIG. 6 illustrating the retention systems on the first and second connector housings when fully matedly engaged.

As illustrated in FIGS. 5 through 7, it lies within the contemplation of the present invention to utilize the retaining clip 80 to additionally attach one connector housing 12 to a second housing 12' having a retention system 10 in accordance with this invention. To this end, in the preferred embodiment, the latch bar portion 94 of the clip 80 has at least one dimple 114 formed therein. More preferable, however, is to provide a pair of dimples 114A, 114B on the latch bar 94. This arrangement of two dimples is shown in the Figures and is believed to enhance the flexibility of the latch bar 94, allowing it to deflect over the abutment member 60. Moreover, if the latch bar 94 is lobed, each lobe may have dimple therein.

A retention system 10 is attached to at least one endwall 40 on each of the housings 12, 12'. However, one of the housings 12' must be arranged with the endwall 42 of the contact casing portion 20 offset by the clearance distance 44 from the endwall 40 of the base portion 18. The latch bar portion 94 of the retention system 10 on the housing 12 will then be insertable into the clearance space so defined on the housing 12', thus to permit the dimples 114 on the latch bars 94 to engage, as is illustrated in FIG. 6 and 7. Such an arrangement permits the retaining clip 80 of the retention system 10 on the housing 12 to serve a dual purpose, viz., to retain the housing 12 with which it is associated to the surface 14 of a substrate 16 and to attach one housing 12 to an associated second housing 12'. Assuming suitable electrical interconnection is made, the mated dimples 114 and associated retaining clips 80 may be used to provide a ground path from one board to another.

Those skilled in the art, having the teachings of the present invention as hereinabove set forth, may effect numerous modifications thereto. It should be understood that these and such modifications lie within the contemplation of the present invention, as defined by the appended claims.

What is claimed is:

1. A retention system for retaining a connector housing to a substrate, the housing having a first and second surface and a first and second endwall thereon, the housing having a recess therein extending between the first and second surfaces, a plurality of electrical contacts being disposed within the recess in the housing, the electrical contacts being insertable into the housing from the first surface thereof, the first surface of the housing lying proximal to the substrate when the connector is retained thereto, the retention system comprising;

a pair of arms extending from at least the first endwall, the arms being undercut, the undercut arms cooperating to define a channel, the channel having an inlet end presented toward the first surface of the housing, a wedge-shaped abutment member having a camming surface and a latching surface thereon, the abutment member being disposed on the first endwall intermediate the arms of the pair of arms, the camming surface having a first and a second end, the abutment member having a predetermined length dimension defined on the endwall between the first end of the camming surface and the latching surface, the first end of the camming surface being presented to the first surface of the housing, the camming surface ramping outwardly from the endwall between the first and second ends thereof such that the second end of the camming surface is disposed a predetermined distance from the endwall, and a retaining clip having at least a base leg and a latching leg thereon, the clip having an opening formed therein, the opening defining a latch bar on the latching leg, the opening having a length dimension equal to the length of the abutment member, the first leg of the clip being insertable into the channel from the inlet end thereof, the latch bar being deflectable by the camming surface as the first leg of the clip advances into the channel until the latch bar snaps into latching engagement with the latching surface at the second end of the abutment member, thereby to secure the clip to the housing, the second leg of the clip being securable to a substrate, thereby to retain the housing to a substrate.

2. The retention system of claim 1 wherein the latch bar has a dimple formed therein.

3. The retention system of claim 2 wherein the latch bar is spaced a predetermined clearance distance from the endwall, the clearance distance being sized to accommodate a second latch bar associated with a second retention system, the second latch bar having a dimple therein, the dimples on the first and the second latch bars being matedly engagable.

4. The retention system of claim 1 wherein the latch bar has a first and a second shoulder thereon, the shoulders abutting with the arms when the clip is secured to the housing.

5. The retention system of claim 4 wherein the distance between the inlet end of the channel and the latching surface is equal to the distance between the shoulder and the latch bar.

6. The retention system of claim 1 wherein the second leg of the clip has a first and a second surface thereon, the second surface being attachable to a substrate.

7. The retention system of claim 1 wherein the first surface of the housing defines a first peripheral edge, the first end of the camming of the abutment member being disposed within a predetermined distance of the first peripheral edge of the housing.

8. The retention system of claim 7 wherein the first end of the camming surface is adjacent to the first peripheral edge of the housing.

9. The retention system of claim 1 wherein the first surface of the housing defines a first peripheral edge, and wherein the first end of the camming surface of the abutment member meets the first edge of the housing.

10. The retention system of claim 1 wherein the slots in the arms are inclined thereby to define a dovetail shaped channel.

11. A retention system for retaining a connector housing to a substrate, the housing having a first and a second surface and a first and second endwall thereon, the housing having a recess therein extending between the first and second surfaces, a plurality of electrical contacts being disposed within the recess in the housing, the electrical contacts being insertable into the housing from the first surface thereof, the first surface of the housing lying proximal to the substrate when the connector is retained thereto, the retention system comprising:

a pair of arms extending from each endwall, each of the arms in each pair being undercut, the undercut arms cooperating to define a channel associated with each endwall, each channel having an inlet end presented toward the first surface of the housing, each endwall having a wedge-shaped abutment member thereon, each abutment member having a camming surface and a latching surface thereon, each abutment member being disposed on an endwall intermediate the arms of the pair of arms thereon, each camming surface having a first and a second end, each abutment member having a predetermined length dimension defined on the endwall between the first end of the camming surface and the latching surface, the first end of the camming surface of each abutment member being presented to the first surface of the housing, the camming surface of each abutment member ramping outwardly from the endwall between the first and second ends thereof such that the second end of the camming surface is disposed a predetermined distance from the endwall, and a first and a second retaining clip, each clip being associated with a respective one of the abutment members, each clip having at least a base leg and a latching leg thereon, each clip having an opening formed therein, each opening defining a latch bar on each latching leg, each opening having a length dimension equal to the length of the abutment member with which it is associated, the first leg of each clip being insertable into one of the channels from the inlet end thereof, the latch bar on each clip being deflectable by the camming surface of an abutment member as the first leg of the clip advances into the channel until each latch bar snaps into latching engagement with the latching surface at the second end of an abutment member, thereby to secure each clip to the housing, second leg of each clip being securable to a substrate, thereby to retain the housing to a substrate.

12. The retention system of claim 11 wherein each latch bar has a dimple formed therein.

13. The retention system of claim 12 wherein the latch bar on each clip is spaced a predetermined clearance distance from the endwall with which it is associated, the clearance distance being seized to accommodate a second latch bar associated with a second retention system, the second latch bar having a dimple therein, the dimples on the first and the second latch bars being matedly engagable.

14. The retention system of claim 11 wherein each latch bar has a first and a second shoulder thereon, the shoulders on each latch bar abutting with the arms in each pair of arms when the clip is secured to the husing.

15. The retention system of claim 14 wherein the distance between the inlet end of the channel and the latching surface is equal to the distance between the shoulder and the latch bar.

16. The retention system of claim 11 wherein the second leg of each clip has a first and a second surface thereon, the second surface on each leg being attachable to a substrate.

17. The retention system of claim 11 wherein the first surface of the housing defines a first peripheral edge, the first end of the camming surface of each abutment member being disposed within a predetermined distance of the first peripheral edge of the housing.

18. The retention system of claim 17 wherein the first end of each camming surface is adjacent to the first peripheral edge of the housing.

19. The retention system of claim 11 wherein the first surface of the housing defines a first peripheral edge, and wherein the first end of each camming surface of each abutment member meets the first edge of the housing.

20. The retention system of claim 11 wherein the slots in the arms in each pair of arms are inclined such that each channel is dovetailed in shape.

* * * * *